US006370746B1

(12) United States Patent
Hinchliffe et al.

(10) Patent No.: US 6,370,746 B1
(45) Date of Patent: Apr. 16, 2002

(54) YARN TREATMENT JET

(75) Inventors: Malcolm Geoffrey Hinchliffe, Macclesfield; Reginald Leah, deceased, late of Prestbury; Jennifer Susan Leah, Prestbury, all of (GB), legal representative

(73) Assignee: Fibreguide Limited (GB)

( * ) Notice: Subject to any disclaimer, the term of this patent is extended or adjusted under 35 U.S.C. 154(b) by 0 days.

(21) Appl. No.: 09/620,868

(22) Filed: Jul. 21, 2000

(30) Foreign Application Priority Data

Jul. 22, 1999 (GB) ..... 9917069

(51) Int. Cl.[7] ..... D02G 1/16; D02J 1/08
(52) U.S. Cl. ..... 28/273; 28/254
(58) Field of Search ..... 28/273, 274, 276, 28/271, 254, 255, 256

(56) References Cited

U.S. PATENT DOCUMENTS

| | | | | | |
|---|---|---|---|---|---|
| 3,694,131 | A | * | 9/1972 | Stuart | 28/273 |
| 3,714,686 | A | * | 2/1973 | Schmid et al. | 28/273 |
| 3,805,343 | A | * | 4/1974 | Ethridge | 28/273 |
| 3,970,231 | A | | 7/1976 | Strutz et al. | 226/7 |
| 4,041,583 | A | * | 8/1977 | Hart et al. | 28/273 |
| 4,095,320 | A | | 6/1978 | Polney | 28/273 |
| 4,181,247 | A | * | 1/1980 | McFall | 28/273 |
| 4,807,431 | A | * | 2/1989 | Braxmeier | 28/273 |
| 5,140,729 | A | | 8/1992 | Simmen | 28/271 |
| 5,241,730 | A | * | 9/1993 | Simmen et al. | 28/273 |
| 5,433,365 | A | * | 7/1995 | Davies | 28/273 |
| 5,511,295 | A | | 4/1996 | Shah | 28/254 |
| 5,526,850 | A | * | 6/1996 | Sora et al. | 28/273 |
| 5,579,566 | A | * | 12/1996 | Burkhardt et al. | 28/273 |

FOREIGN PATENT DOCUMENTS

| | | | | |
|---|---|---|---|---|
| JP | 45-22903 | * | 7/1970 | 28/273 |
| JP | 57-183431 | | 11/1982 | D02J/1/08 |

* cited by examiner

*Primary Examiner*—Amy B. Vanatta
(74) *Attorney, Agent, or Firm*—Schwegman, Lundberg, Woessner & Kluth, P.A.

(57) ABSTRACT

A yarn treatment jet is provided having a venturi member with a venturi shaped bore, and an inlet member with a yarn passage therethrough located in the mouth of the bore, in which the inlet member is in contact with the mouth of the bore to locate the inlet member positively relative to the venturi member and is configured to provide a passage for air into the venturi bore between the inlet member and the venturi member. The inlet member may be formed of a core and a needle so that to change the configuration of the air passage only the core need be changed. The air passage is formed by one or more grooves or bores in the inlet member or core.

11 Claims, 2 Drawing Sheets

YARN TREATMENT JET

FIELD OF THE INVENTION

This invention relates to air jets for treating textile yarns, in particular for texturing multifilament yarns by subjecting the filaments to a turbulent airflow to increase the bulk of the yarns.

BACKGROUND OF THE INVENTION

There are many such air texturing jets of differing designs currently in use, but they tend to fall within two basic types. The first type is an extrapolation of current interlacing jet technology, and consists of a tube through the bore of which the yarn to be textured is fed to be impinged upon by an air jet which enters the bore laterally through a side inlet. The air inlet may be angled to the longitudinal axis of the tube so that the incoming jet of air gives the yarn a forwarding impetus as well as bulking the yarn. Such a jet has good performance on low denier, singles and low overfeed yarn. The simple jet tube is tolerance sensitive to manufacture and has limited overfeed potential. The second type is a "needle" jet, comprising a venturi tube through which the yarn to be textured is fed, and a "needle" which is located axially in the "mouth" of the venturi tube to create an annular inlet for the a turbulent flow of air to enter the venturi. This second type performs better than the first type, particularly on heavier denier and high overfeed yarns. However, such a jet is more difficult to manufacture than the first type, and is extremely tolerance sensitive, since small differences in dimensions and setting create substantial air velocity differences and hence substantial variations in bulk levels imparted to the yarn. The flow of air into the venturi tube, and hence the degree of bulking of the yarn, is controlled by the annular restriction between the needle and the mouth of the venturi tube, a restriction which is very sensitive to the tolerances of manufacture of the needle and venturi tube and their relative positioning. In consequence the second type of air jet is very difficult to control in an attempt to obtain texturing consistency from position to position on a single machine or from machine to machine, and delicate adjustment is required to achieve optimum performance for a given type of yarn.

OBJECTS OF THE INVENTION

It is an object of the present invention to provide a yarn treatment jet of the second type, but with good control and with no or with minimum problems of manufacturing tolerance sensitivity. It is also an object of the present invention to provide an air jet which achieves the highest air velocities consistently with consistent high levels of turbulence to create maximum yarn tension. It is a further object to provide added flexibility of air jet construction for direct control of the air turbulence and for special yarn effects.

SUMMARY OF THE INVENTION

The invention provides an yarn treatment jet comprising a venturi member having a venturi shaped bore therethrough and extending downstream of a mouth of the bore, and an inlet member having a yarn passage therethrough and located in the mouth of the bore, wherein the inlet member is in contact with the mouth of the bore to locate the inlet member relative to the venturi member and is configured to provide a passage for air into the venturi bore between the inlet member and the venturi member.

Preferably the yarn passage in the inlet member is axially aligned with the venturi bore. The inlet member may comprise a core and a needle in mutual relatively locating contact, and the needle may have a yarn passage axially aligned with a yarn passage in the core. The air passage may comprise at least one groove in the outer surface of the inlet member and extending in the axial direction thereof. Alternatively, the air passage may be formed as at least one non-axial bore through the inlet member. The grooves or non-axial bores may be disposed in a circumferentially symmetrical arrangement, and may communicate with an annular chamber disposed between the inlet member and the venturi member. The annular chamber may have an axial length of up to 5 mm, and may be substantially 3.5 mm in length.

BRIEF DESCRIPTION OF THE DRAWINGS

The invention will now be further described with reference to the accompanying drawings in which.

DESCRIPTION OF THE PREFERRED EMBODIMENTS

Figure 1:
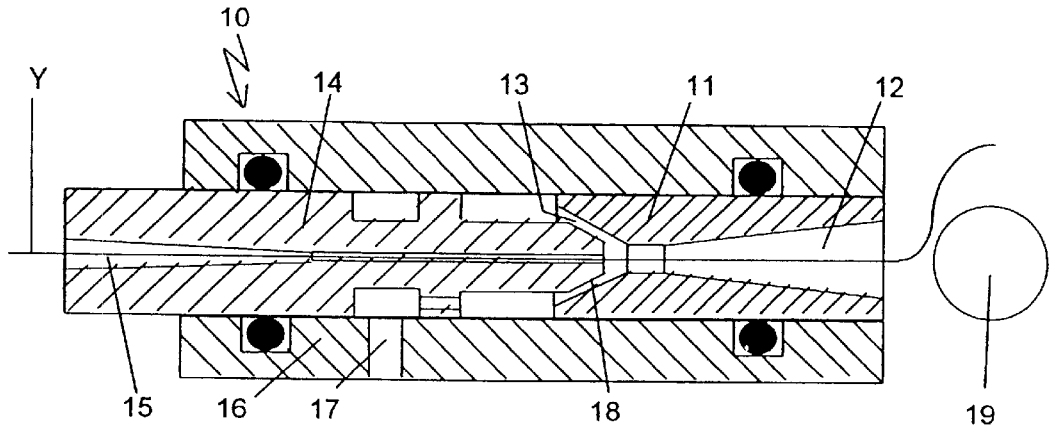
Fig. 1 Prior Art
FIG. 1 is a longitudinal section of a typical known air jet of the needle type.

Referring now to FIG. 1, there is shown a typical known air jet 10 of the needle type for texturing a multifilament yarn Y. The texturing jet 10 comprises a venturi tube 11 having a venturi shaped bore 12 extending downstream of a mouth 13. Disposed upstream of the tube 11 is an inlet member or needle 14 having a yarn passage 15 extending therethrough. The tube 11 and needle 14 are mounted in a housing 16 so that the yarn passage 15 is axially aligned with the venturi bore 12. Air is passed into the interior of the housing 16 through a lateral air inlet 17. The downstream end of the needle 14 is disposed within the mouth 13 to provide an annular passage 18 for air from the interior of the housing 16 into the venturi bore 12. The yarn Y passes through the yarn passage 15 into the venturi bore 12 where it is impinged upon by the turbulent inflow of air through the annular passage 18. This has the effect of creating convolutions in the filaments of the yarn Y, thereby increasing the bulk of the yarn Y as it is entrained by the high speed turbulent airflow. The yarn Y passes out of the jet 10 to impinge on a baffle pin or plate 19 which substantially destroys the yarn's forward momentum and assists in causing convolution of the filaments. The degree of bulking of the yarn Y is dependent on the nature of the turbulent airflow in the venturi bore 12, which is itself dependent on the dimensions of the annular passage 18. These dimensions are very tolerance and setting sensitive as described above, leading to difficulty in controlling the airflow and bulk level and consistency from jet to jet.

Figure 2:
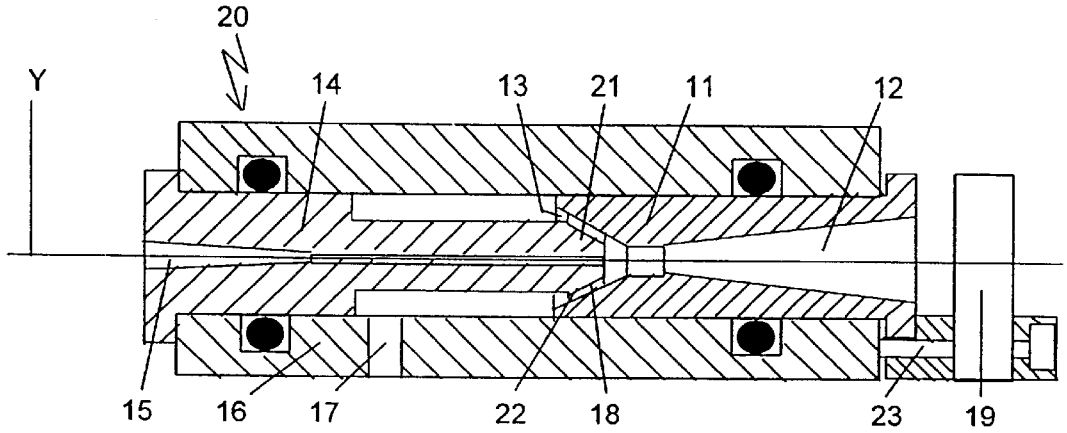
FIG. 2 is a longitudinal section of a first embodiment of air jet according to the invention.

Referring now to FIG. 2, there is shown a texturing jet 20 also of the needle type. Parts of the jet 20 having the same function as the corresponding parts of the jet 10 are identified by the same reference numerals. In this case however, the inlet member or needle 14 has a conical end 21 which contacts the mouth 13 of venturi bore 12 to locate the needle 14 and the venturi tube 11 relative to each other. The conical end 21 has grooves 22 extending in the axial direction of the jet 20 and which form the air passage 18. A screw 23 maintains this mutual contact and hence relative location of the needle 14 and venturi tube 11. By this means the setting of the needle 14 relative to the venturi tube 11 is fixed, and the dimensions of the air passage 18 are tolerance sensitive only as regards the manufacturing tolerance of the grooves 22. In consequence, consistency of bulking of yarns Y from jet 20 to jet 20 is more readily achieved than with the known jets 10. Furthermore, by suitable choice of the geometry of the grooves 22, control of the turbulence of the air in the venturi bore 12, and the consequent bulking characteristics in the yarn Y, can be obtained. Such a jet 20 having a particular configuration of grooves 22 and with a particular inflow of air is suitable for producing a predetermined bulking level of a particular yarn Y, and variations in bulk level can be achieved by changing the air pressure and flow rate. As an alternative to the screw 23, a spring (not shown) may maintain the mutual contact between, and hence relative location of, the needle 14 and the venturi tube 11.

Figure 3:
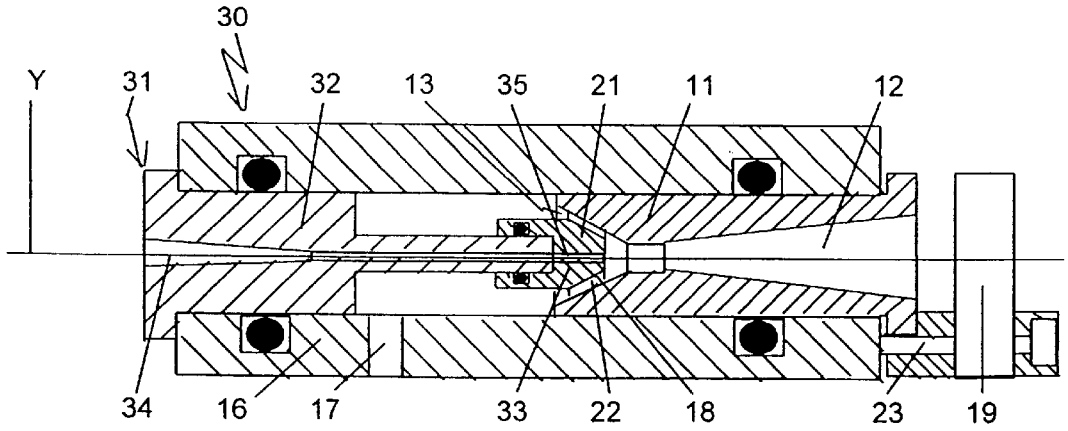
FIG. 3 is a longitudinal section of a second embodiment.
Figure 4:
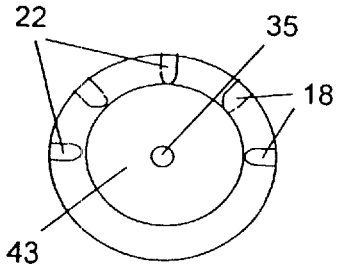
FIGS. 4 to 6 are end views of different cores for use with the embodiment of FIG. 3, FIGS. 7 and 8 are sectional and end views respectively of an alternative core.
Figure 5:
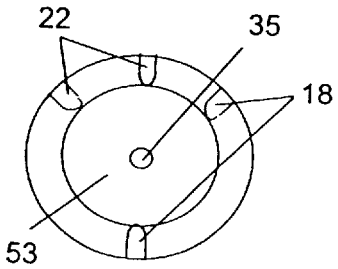
Figure 6:
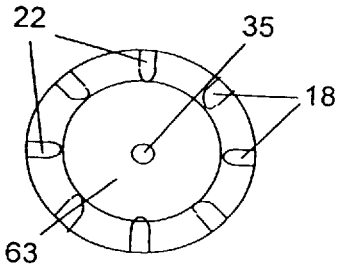
Figure 7:
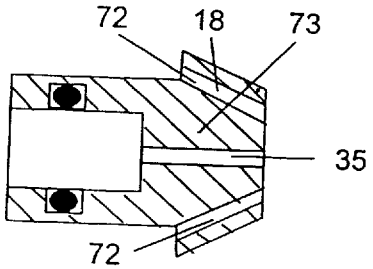
Figure 8:
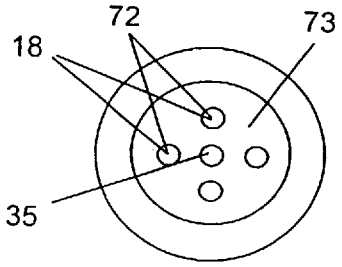
Figure 9:
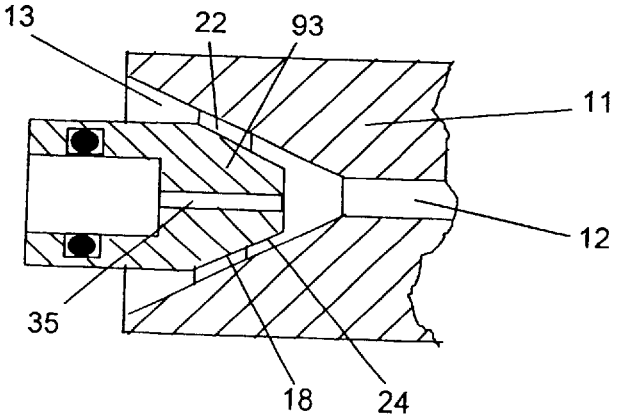
FIG. 9 is a longitudinal section of an alternative core.

Referring now to FIG. 3, there is shown a texturing jet 30 in which the inlet member 31 comprises a needle 32 and a core 33 which are detachably secured to each other. The needle 32 and the core 33 have yarn passages 34 and 35 respectively which are in axial alignment with each other and with the venturi bore 12. In this case it is the core 33 that has a conical end 21 and grooves 22 therein forming the air passage 18. The advantage of this embodiment over the jet 20 embodiment is that in order to alter the degree and nature of the bulking of differing yarns Y, only the core 33 need be changed to one with a different geometry of grooves 22, as shown in FIGS. 4 to 6. In the cases of the cores 43 and 53 there is an asymmetrical arrangement of grooves 22, whereas in the case of core 63 there is a symmetrical arrangement of grooves 22. In the case of the core 73 of FIGS. 7 and 8, or the conical end 21 of the inlet member 14 of the FIG. 2 embodiment, the air passage 18 is formed by a plurality of non-axial bores 72, four such bores 72 in a symmetrical arrangement being shown. The angle of the bores 72 relative to the axis of the yarn passage 35 can be chosen to give any desired angle of impingement of the air on the yarn Y to optimise the turbulence and velocity of the impinging air. The grooves 22 or bores 72 may communicate with an annular chamber 24 between the core 93, or the conical end 21 of the inlet member 14, and the venturi tube 11, as shown in FIG. 9. The annular chamber 24 may have a length of up to 5 mm longitudinally of the jet 20, and is preferably 3.5 mm in length.

It will be obvious to persons skilled in the art that a large number of cores 33, 43, 53, 63, 73 with a variety of numbers, arrangements and dimensions of grooves 22 or bores 72 can be provided so that any desired turbulent airflow to create any desired degree and nature of bulking of, and special effects in, the yarns Y can be achieved, for the very low cost of manufacture of the small cores which can be readily interchanged. Hence by means of the invention a great flexibility of control of the texturing process can be achieved at low cost, with simple and rapid interchangeability from one configuration of jet to another.

What is claimed is:

1. A yarn treatment jet comprising a venturi member having a bore there through with a mouth, the bore being venturi shaped and extending downstream of the mouth, and an inlet member having a yarn passage there through and located in the mouth of the bore, wherein the inlet member is in contact with the mouth of the bore to locate the inlet member relative to the venturi member and is configured to provide a passage for air into the venturi bore between the inlet member and the venturi member, and wherein the inlet member comprises a core and a needle that are detachable from each other.

2. A yarn treatment jet according to claim 1, wherein the yarn passage and the venturi bore have respective axes, and the yarn passage in the inlet member is axially aligned with the venturi bore.

3. A yarn treatment jet according to claim 1, wherein the inlet member and the core are in mutual relatively locating contact.

4. A yarn treatment jet according to claim 1, wherein the needle has a needle yarn passage, the core has a core yarn passage and the needle yarn passage is axially aligned with the core yarn passage.

5. A yarn treatment jet according to claim 1, wherein the inlet member has an outer surface and an axis, and the air passage comprises at least one groove in the outer surface of the inlet member and extending in the axial direction thereof.

6. A yarn treatment jet according to claim 5, wherein the air passage comprises a plurality of grooves in the outer surface of the inlet member and extending in the axial direction thereof, and the grooves are disposed in a circumferentially symmetrical arrangement.

7. A yarn treatment jet according to claim 1, wherein the air passage is formed as at least one non-axial bore through the inlet member.

8. A yarn treatment jet according to claim 7, wherein the air passage comprises a plurality of non-axial bores through the inlet member, and the bores are disposed in a circumferentially symmetrical arrangement.

9. A yarn treatment jet according to claim 1, comprising an annular chamber between the inlet member and the venturi member, and the air passage communicates with the annular chamber.

10. A yarn treatment jet according to claim 9, wherein the annular chamber has a length of up to 5 mm longitudinally of the jet.

11. A yarn treatment jet according to claim 10, wherein the annular chamber has a length of substantially 3.5 mm longitudinally of the jet.

* * * * *